United States Patent [19]

McCain et al.

[11] Patent Number: 4,519,598

[45] Date of Patent: May 28, 1985

[54] SIGNATURE GATHERING MACHINE WITH SEGMENT WHEEL CALIBRATED TO MAIN DRIVE SHAFT

[75] Inventors: William B. McCain, Hinsdale; Elmer Bewersdorf, Downers Grove, both of Ill.

[73] Assignee: McCain Manufacturing Corporation, Chicago, Ill.

[21] Appl. No.: 596,233

[22] Filed: Apr. 2, 1984

[51] Int. Cl.[3] ..... B42B 2/00

[52] U.S. Cl. ..... 270/53; 270/60

[58] Field of Search ..... 270/53, 54–55, 270/57, 60, 13; 198/644

[56] References Cited

U.S. PATENT DOCUMENTS

| | | | |
|---|---|---|---|
| 1,267,354 | 5/1918 | Barber et al. | 270/60 |
| 1,833,311 | 11/1931 | Winkler et al. | 270/57 |
| 2,626,074 | 1/1953 | Vogt | 270/54 X |
| 3,087,721 | 4/1963 | McCain | 270/54 |
| 3,658,318 | 4/1972 | Bunting et al. | 270/53 |
| 3,717,337 | 2/1973 | McCain et al. | 270/54 |
| 4,180,255 | 12/1979 | Himmel | 270/54 |

*Primary Examiner*—E. H. Eickholt

*Attorney, Agent, or Firm*—Kinzer, Plyer, Dorn & McEachran

[57] ABSTRACT

An insert is incorporated in a book of gathered signatures by a segment wheel which makes one-half turn per machine cycle; to calibrate the speed of the wheel to the lineal speed of the signature a coupling incorporating principles of a Whitworth drive is interposed between the main drive shaft of the machine and the drive for the wheel.

5 Claims, 4 Drawing Figures

SIGNATURE GATHERING MACHINE WITH SEGMENT WHEEL CALIBRATED TO MAIN DRIVE SHAFT

This invention relates to signature gatherers of the kind in which folded sheets are delivered from separate pockets or hoppers to a moving gatherer which collects the signatures one atop another in successive cycles of the machine to complete a book which is afterwards bound and trimmed.

It is customary in many instances to deliver a separate insert such as a return mailing card, premium coupon or notice concurrently for association with the signatures and the present invention is concerned with a known delivery mechanism having a wheel for capturing an insert at the side of the signature gatherer, moving it past a glue dabber and releasing the insert to one of the signature sheets to which it is adhered by the glue. The object of the present invention is to enable the known arrangement to be incorporated in a signature gatherer in which so-called pin-spacing on the gatherer may be a variable. Thus the signature gatherer ordinarily comprises a chain or even a flat belt having spaced pins, lugs or the like which engage the trailing edges of the signatures to maintain the signatures in proper book array for binding. As can be readily envisioned, this pin-spacing (or lug-spacing) may vary because of different books, such that the spacing in one gatherer may be a 14" separation per machine cycle, while at another extreme the spacing may be as much as 20" per machine cycle.

However, the known device for adhering the inserts to the successive signature groups comprises a delivery wheel of definite circumference and we were faced with the problem of the plain fact that a match between the lineal speed of the gatherer and the insert wheel, at the time of releasing the insert to the gathered signatures, could only be a fortuitous event. The problem indeed was (or is) exacerbated by the fact that the wheel of the known device has two segments, feeding two inserts per 360° of wheel rotation which introduces the further difficulty that one rotation or cycle of the insert wheel would have to match two cycles of the signature gatherer, a machine cycle being defined herein as the movement of two successive gathering pins past a given point. Indeed the given point may be taken as the point where the insert sheet is to be released and adhered to the signature group.

Another object of the invention is to adopt a principle of calibration which itself can be easily corrected for a variation in pin spacing. Specifically, an object of the present invention is to solve the problem by using in part the principle of a Whitworth drive to enable the calibration to be effectively and readily accomplished.

IN THE DRAWING

SUMMARY: FIGS. 3 AND 4

The gathering chain (or belt) of a signature gatherer moves at a continuous lineal speed along a path 10.

Figure 3:
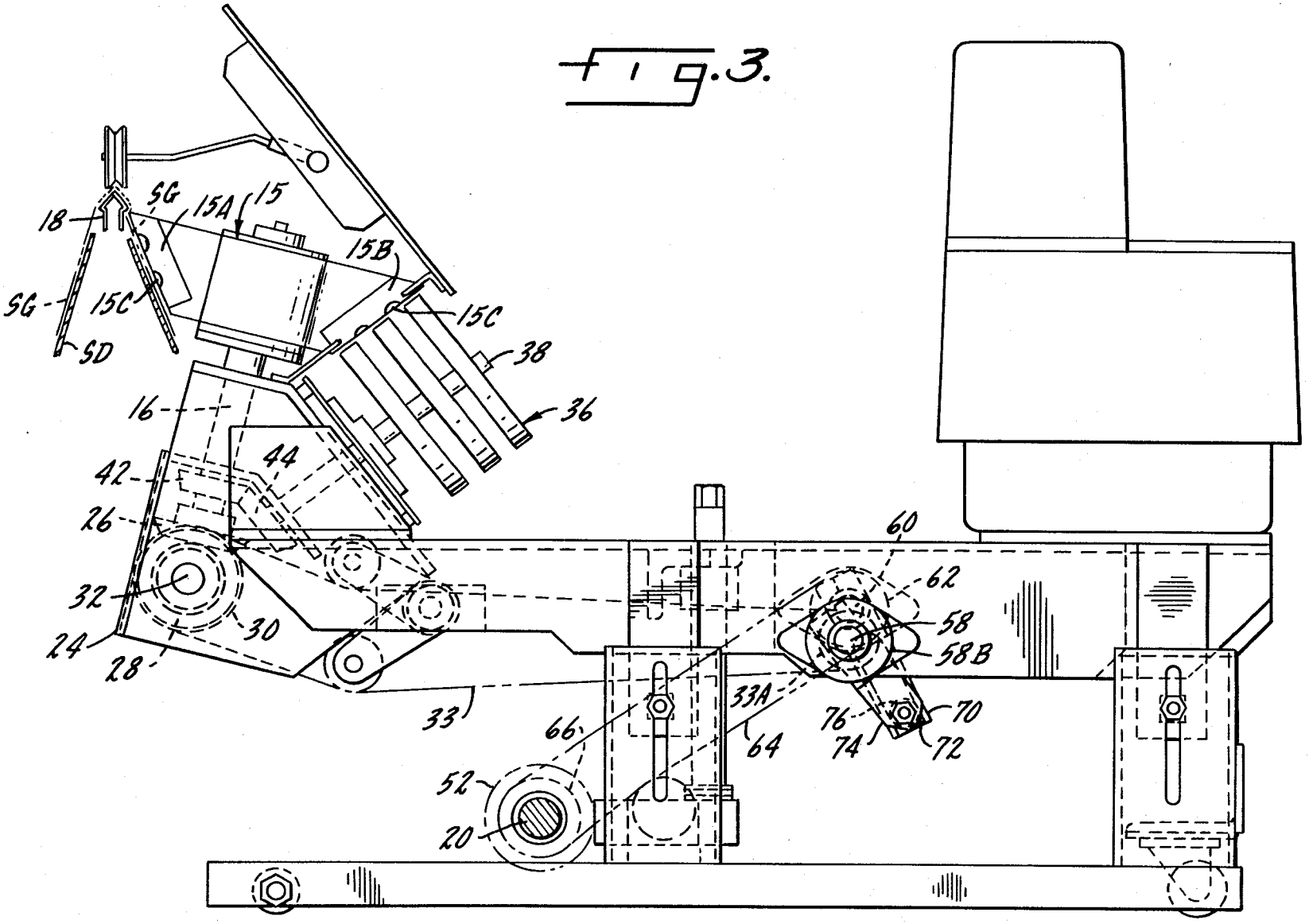
FIG. 3 is a side elevation of a machine constructed in accordance with the present invention.

A constantly rotating segment wheel 15, rotated by a tilted shaft 16, FIG. 3, transfers an insert to each passing group of gathered signatures, the insert to become part of the book. The two segments 15A and 15B of the wheel are displaced by 180° so that for each 360° turn successive inserts are transferred.

In the instance of a saddle gatherer, having a saddle SD, FIG. 3, for supporting the gathered signature group SG, the gatherer is a chain supporting spaced pins 18 which move the gathered signatures past the hoppers which feed signatures successively to the gatherer, timed to the cyclical spacing of the pins. This spacing may be 14" per unit of time or it may for example be 15" or 20" per unit of time, defined as a machine cycle. The cylical drive is generated by a so-called line shaft 20 which is the main drive shaft.

Figure 1:
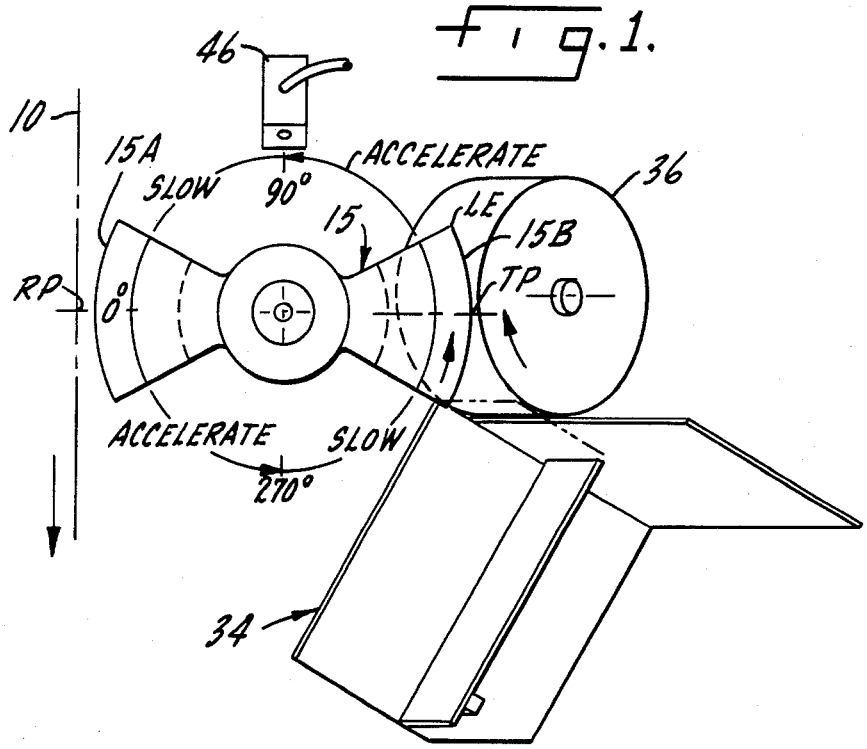
FIG. 1 is a projection in a horizontal plane of certain equipment for capturing, delivering and releasing the insert to the signature.

The insert applying wheel and its related magazine and associated parts, FIG. 1, represent known equipment and do not constitute part of this invention. The wheel 15 has a given circumference and it has a gear reduction box, FIG. 3, of fixed and determined ratios. In any event, to employ the known equipment with a signature gatherer with cyclical pin spacing the wheel segment as 15A, when tangent to the signature at the insert release position denoted RP in FIG. 4, requires the segment to be moving at substantially the same lineal speed as the signature group when the insert is offset or transferred (via gluing) from the wheel to the opposed signature page. But if the wheel drive is to be coupled to or driven via the main drive shaft and has two segments arrayed in effective circumference of forty-two inches, it can be readily seen that such matching of lineal speeds does not and cannot prevail. Further, if different users have different machine cycles, or indeed if the user wants to change the cycle by spacing the gatherer pins or lugs differently, this will involve custom building rather than mass production.

Figure 2:
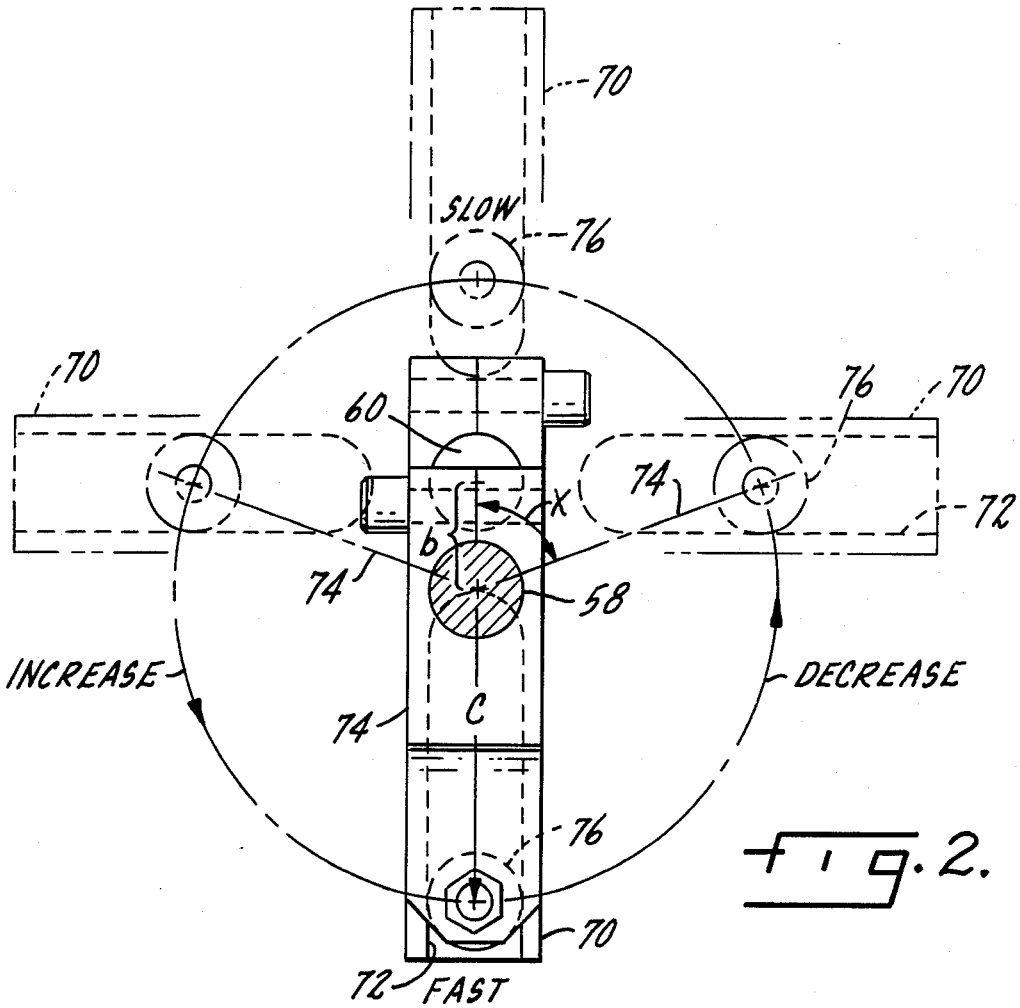
FIG. 2 is a plan view on an enlarged scale of the drive means employed for calibrating.

The problem is solved under the present invention by interposing a coupling having the attribute of a so-called Whitworth drive, FIG. 2, interposed between the main machine drive and the drive of the wheel 15.

DETAILS OF CONSTRUCTION

The drive shaft 16 for the wheel 15 is tilted, FIG. 3, and the segments 15A and 15B which carry the inserts to become part of the books are slanted so that the plane of the insert sheet at the time of release to the signature group will be substantially in the same plane due to the signature group being draped over the saddle SD.

The wheel drive shaft 16 is disposed within a gear box 24 and is rotated by meshed bevel gears 26 and 28, bevel gear 28 being driven by a sprocket 30 on the same shaft 32 as the bevel gear 28.

The sprocket 30 is driven by a chain 33 and this chain is driven in a manner to be described.

The inserts to become part of the signature groups are contained in a supply magazine 34, FIG. 1, and they feed by gravity to a transfer wheel 36 provided with grippers (not shown) which clamp the exposed edge of a fresh insert and withdraw it from the magazine in the course of rotation of the wheel 36. As shown in FIG. 3, wheel 36 has a driven shaft 38 rotated cyclically with the wheel drive shaft 16 by virtue of meshed bevel gears 42 and 44.

A card or other sheet constituting the insert to be delivered from magazine 34 has its edge presented to the mechanical grippers (not shown) on the wheel 36 by suction cups (not shown), and as the mechanical grippers move therepast they grab the exposed or presented edge of the insert to effectively and forcefully withdraw the insert from the magazine 34.

As shown in FIG. 3, the wheel segments 15A and 15B are provided with air openings 15C. When the leading edge LE of a wheel segment is approximately at the transfer point TP, FIG. 1, suction prevails in the openings 15C so that the segment as 15B is conditioned to hold an insert when released by the wheel 36. The mechanical grippers on the wheel 36 when opened release the insert to the wheel 15, held to the wheel segment by the suction.

Continued rotation of the wheel 15, FIG. 1, carries the insert past a glue dabber 46 which applies an effective dab or spot of glue to the outwardly facing side of the insert. Rotation of the segment 15B counterclockwise beyond the glue dabber 46 carries the insert toward the moving line of signatures and when this insert is at the releasing point RP (or about one inch displaced from RP) suction applied to the segment 15B is released and mild positive pressure prevails which, coupled with the glue dab, causes transfer or release of the insert to the signature, all of which occurs within approximately one inch of travel of the wheel 15, now moving at the lineal speed of the gathered signature group, as will be explained. As this is occurring with respect to segment 15B, segment 15A is at the opposed 180° position, figured from the releasing point RP, and is in the course of having its leading edge LE advancing in the direction of the glue dabber.

What has been described above in terms of the wheels 15 and 36, their gears and shafts, transfer of the insert from the magazine 34 to the wheel 36, transfer of the insert from the wheel 36 to the segment of the wheel 15, the glue dab sequence and release to a signature sheet constitute the arrangement and operation of a known device. The present invention, concerned with calibrating the lineal speed of the wheel segment at the time of signature release will now be described.

CALIBRATING THE LINEAL SPEED AT THE TIME OF INSERT TRANSFER

Figure 4:
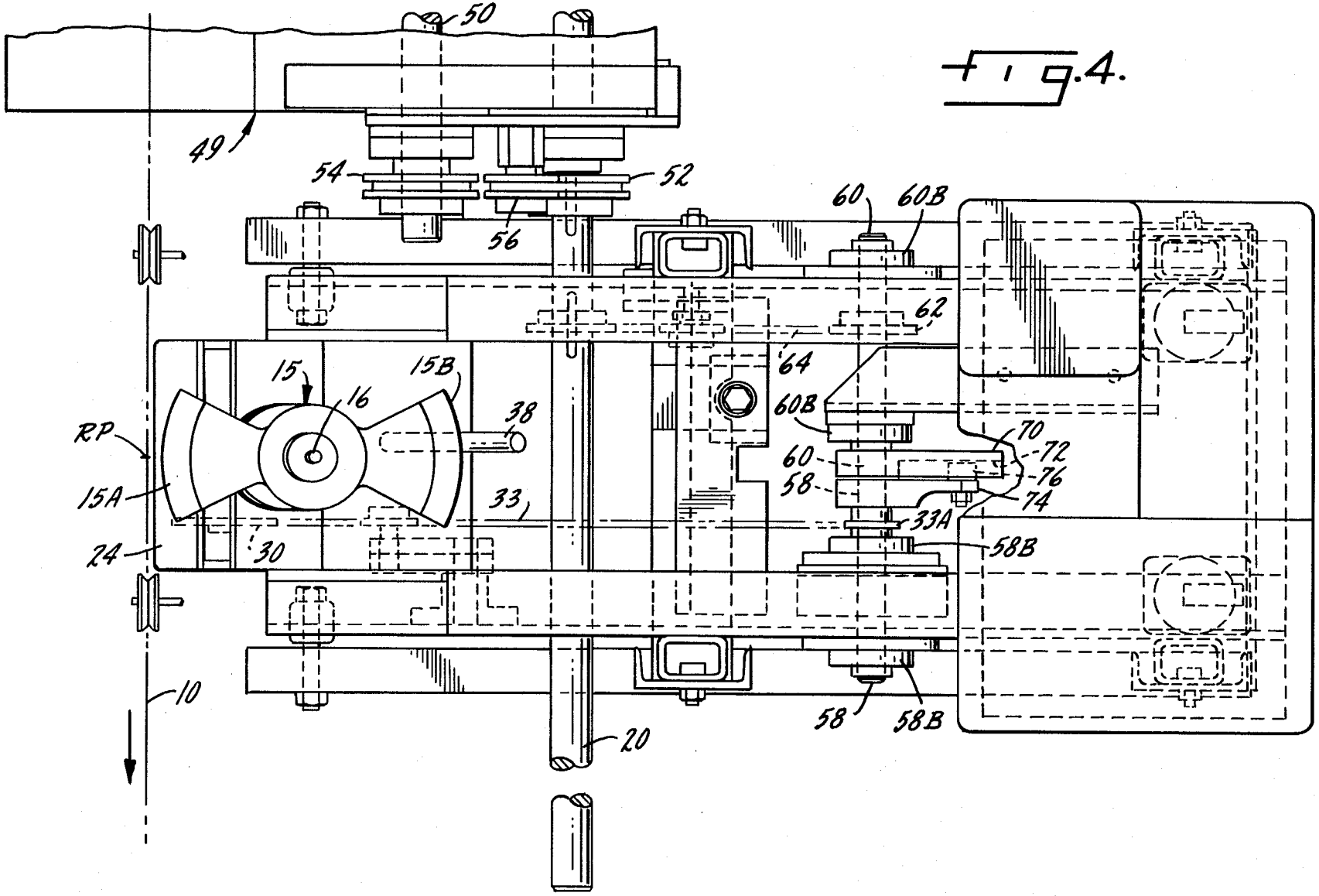
FIG. 4 is a top plan view of the structure shown in FIG. 3 with a cover plate removed.

The signature gatherer derives its speed from the main drive shaft 20. As shown in FIG. 4, there is a hopper or signature pocket configuration 49, positioned, as any other signature pocket, at one side of the gathering path 10. This pocket or hopper holds a supply of identical signatures which are fed one by one to the gathering chain to become part of the signature group and it may be assumed that the signature fed from pocket 49 will be the signature with which the insert is to be associated. Since the pocket delivery rate must be coincident with the lineal speed or rate of the gathering chain, the pocket feeder or drive shaft 50, FIG. 4, is coupled in a 1:1 drive ratio with the main drive shaft 20 by virtue of a drive sprocket 52 on drive shaft 20 coupled by a chain (not shown) to a driven sprocket 54 on the pocket feeder shaft 50. An idler or tensioning sprocket 56 may be employed.

In order accurately to calibrate the lineal speed of the wheel segment at the time of transferring or releasing an insert to the gathered signatures, and in order that this may be a selective calibration for different cyclical pin spacing, chain 33 is driven by a sprocket 33A on a driven shaft 58, FIGS. 3 and 4. As shown in FIG. 4, the driven shaft 58 lies in the same vertical plane as an opposed drive shaft 60 but as shown in FIG. 3, the two shafts are offset in this plane so that in the form shown the driven shaft 58 is displaced below the axis of the drive shaft 60. Further, the drive shaft 60 is provided with a drive sprocket 62, FIG. 4, rotated by a chain 64 which in turn is coupled to a driving sprocket 66 on the main drive shaft 20. The sprockets 62 and 66 are of the same diameter and hence the drive shaft 60 is synchronized to the main drive shaft 20.

A drive arm 70 is fixed to the drive shaft 60. This drive shaft presents a slot 72. A driven arm 74 is coupled to the inner end of shaft 58 adjacent the inner end of the drive shaft 60. The driven arm 74, at its free end, has a roller 76 pinned thereto and this roller is disposed in the slot 72 so that as the drive arm 70 rotates with the drive shaft 60, the driven arm 74 is rotated by virtue of the coupling represented by the roller 76 in the drive slot 72. Shaft 58 is therefore driven by the rotating arm 74 and the rotation of shaft 58 is transmitted by the chain 33 to shaft 32 which, through the bevel gearing identified above, rotates the wheel shaft 16 and also wheel shaft 38.

Drive shaft 60 and its driven shaft 58 turn cyclically in synchronization with the main drive shaft 20, moving the gathering chain (in the assumed circumstance) through a 14" cycle spacing. However, wheel 15 of the known construction explained above delivers two inserts during one complete turn of wheel shaft 16. Therefore a full cycle of the gatherer requires only half a turn of wheel 15, and the gearing in gear box 24 is so geared. Nonetheless the lineal speed of the segment 15A or 15B must match, or practically so, the lineal speed of the gatherer at the release point RP. This calibration can be achieved by selecting the axial displacement between the two shafts 58 and 60 and the effective length of arm 74. The effective length of arm 74 can be readily envisioned from FIG. 4 as the distance between the center of shaft 58 and the center of roller 76. As can be readily envisioned from FIG. 3, the selected displacement between the shafts 58 and 60, which are short length stub shafts with no whiplash, is simply one of properly locating their sturdy bearings 58B and 60B.

FIG. 2 is a diagram showing movement of the roller 76 during a complete turn of the drive arm 70 on shaft 60. It can be seen that the roller 76 will traverse slot 72 from a point of maximum displacement (FAST) to a point of minimum displacement (SLOW) and then back in successive 180° of rotary movement. It can be visualized from FIG. 2 that when roller 76 is at and near its maximum displacement in slot 72 its arm 74 (and therefore driven shaft 58) must necessarily have maximum speed imparted thereto, whereas the converse is the case when the roller is at its minimum displacement in slot 72.

Thus the angular velocity of the pin 76 ($w_p$) is a function of the separation between the centers of rotation of the shafts 58 and 60 (a predetermined length b, FIG. 2) and the effective length of the driven arm 74 (which may be denoted c). The angular velocity of the pin is also a function of (−cos) of the angle x included between the radius (c) of arm 74 and the separation line denoted b in FIG. 2. Angle x varies with the displacement b. The angular velocity of the pin subscribes to the law of cosines and therefore includes the factor ($-2bc \cos x$) so that it can be seen that the angular velocity of the pin is constantly varied in each 180° of turn of shaft 58 not only by the value of the cosine of x but also whether it is plus or minus. The net and practical effect for the purposes of the present invention is as shown in FIG. 1 (remembering that wheel 15 has two revolutions per revolution of shaft 58) where the wheel 15 is constantly undergoing alternate acceleration and slowing in successive 90° turns. Wheel is turning slowly at significant and appropriate times, namely when the insert is being offset to the signature and when (concurrently) the opposed segment of wheel 15 is receiving a fresh insert from the transfer wheel 36. High acceleration at the time of applying the glue dab is not material because this is a mere jet or swipe proposition and no work is being done at the point opposite the glue dabber.

It will be seen from the foregoing that under the present invention it becomes a relatively simple matter to calibrate the speed of wheel 15 so that at the time of offset the insert to be transferred is moving at substantially the same lineal speed as the signature gatherer. This involves merely a selection of separation distance b, FIG. 2, and relocating pin 76 accordingly to vary the effective length (a) of the driven arm 74.

We claim:

1. In a cyclically operable machine for gathering signatures fed by pocket feeders from individual supply pockets to a signature gatherer moving past the pockets at a predetermined lineal speed per machine cycle, in which separate insert sheets or the like delivered from an insert magazine are to be gathered individually with successive signatures, and in which each insert sheet so delivered is captured by a wheel rotated by an upright shaft on an axis at one side of the gatherer, is next moved by the wheel past a glue dabber to receive a spot of glue for adherence to the signature and finally is presented by the wheel for release to and adherence to a signature being advanced by the gatherer:

a main drive shaft for driving the gatherer at a predetermined lineal speed;

a second drive shaft and means for driving the second drive shaft from the main drive shaft;

said second drive shaft having a drive arm fixed thereto to rotate therewith;

a driven shaft immediately adjacent said second drive shaft and having its axis of rotation parallel to and offset from the second drive shaft;

said driven shaft having a driven arm connected thereto and said driven arm supporting one end of a drive pin, which drive pin has the opposite end disposed freely in a slot presented by said drive arm so that as the latter is rotated from 0° through 180° the pin traverses the slot in one direction and traverses the slot in the opposite direction as the drive arm rotates from 180° to 360°;

and a drive connection from said driven shaft to said upright shaft, the offset between the drive shaft and driven shaft and the effective length of the driven arm being selected to calibrate the lineal speed of the wheel to substantially that of the gatherer at the time of release.

2. A machine according to claim 1 in which the position of the driven shaft may be adjusted to vary the shaft offset for machines having different lineal speeds.

3. A machine according to claim 1 in which the effective length of the driven arm may be varied.

4. A machine according to claim 3 in which the driven shaft may be adjusted to vary the offset for machines having different lineal speeds.

5. A machine according to claim 4 in which the effective length of the driven arm may be varied.

* * * * *